US012379165B2

(12) United States Patent
Romlund

(10) Patent No.: US 12,379,165 B2
(45) Date of Patent: Aug. 5, 2025

(54) HEAT EXCHANGER PLATE, AND A PLATE HEAT EXCHANGER

(71) Applicant: ALFA LAVAL CORPORATE AB, Lund (SE)

(72) Inventor: Jens Romlund, Rydebäck (SE)

(73) Assignee: ALFA LAVAL CORPORATE AB, Lund (SE)

( * ) Notice: Subject to any disclaimer, the term of this patent is extended or adjusted under 35 U.S.C. 154(b) by 238 days.

(21) Appl. No.: 17/799,602

(22) PCT Filed: Jan. 15, 2021

(86) PCT No.: PCT/EP2021/050785
§ 371 (c)(1),
(2) Date: Aug. 12, 2022

(87) PCT Pub. No.: WO2021/160370
PCT Pub. Date: Aug. 19, 2021

(65) Prior Publication Data

US 2023/0061944 A1 Mar. 2, 2023

(30) Foreign Application Priority Data

Feb. 14, 2020 (SE) ..... 2050164-9

(51) Int. Cl.
*F28D 9/00* (2006.01)
*F28F 3/04* (2006.01)
*F28D 21/00* (2006.01)

(52) U.S. Cl.
CPC ..... *F28D 9/005* (2013.01); *F28F 3/042* (2013.01); *F28F 3/046* (2013.01); *F28D 2021/0071* (2013.01); *F28F 2225/04* (2013.01)

(58) Field of Classification Search
CPC .. F28D 9/005; F28D 2021/0071; F28F 3/025; F28F 3/042; F28F 3/046; F28F 3/08; F28F 3/10; F28F 2225/04
See application file for complete search history.

(56) References Cited

U.S. PATENT DOCUMENTS 4,987,955 A * 1/1991 Bergqvist ..... F28D 9/0075 165/906
5,794,691 A * 8/1998 Evans ..... F28F 9/0248 165/170

(Continued)

FOREIGN PATENT DOCUMENTS

CN 2847203 Y 12/2006
CN 1888805 A * 1/2007

(Continued)

OTHER PUBLICATIONS

Office Action (Notice of Allowance) issued Nov. 27, 2023, by the Japan Patent Office in corresponding Japanese Patent Application No. 2022-549004 and an English translation of the Office Action. (6 pages).

(Continued)

*Primary Examiner* — Eric S Ruppert
*Assistant Examiner* — Hans R Weiland
(74) *Attorney, Agent, or Firm* — BUCHANAN INGERSOLL & ROONEY PC

(57) ABSTRACT

A plate heat exchanger comprises heat exchanger plates each comprising a heat exchanger area extending in parallel with an extension plane and comprising a corrugation extending from a primary level on one side of the extension plane to a secondary level on an opposite side of the extension plane. Four porthole areas enclose a respective porthole and comprise two first porthole areas comprising a respective annular base area around the porthole at the secondary level. Each first porthole area comprises a first annular ridge around the (Continued)

porthole and projecting from the annular base area to the primary level, and a second annular ridge around and at a distance from the first annular ridge and projecting from the annular base area to the primary level. The first and second annular ridges are through-broken by a number of depressions.

24 Claims, 5 Drawing Sheets

(56) References Cited

U.S. PATENT DOCUMENTS

| | | | | |
|---|---|---|---|---|
| 5,924,484 | A * | 7/1999 | Andersson | F28D 9/005 165/178 |
| 10,724,801 | B2 * | 7/2020 | Mohammadian | F28F 9/026 |
| 2005/0082049 | A1 * | 4/2005 | Brost | F28F 9/026 165/166 |
| 2007/0089871 | A1 * | 4/2007 | Andersson | F28D 9/005 165/167 |
| 2007/0089872 | A1 | 4/2007 | Hou | |
| 2007/0221366 | A1 | 9/2007 | Murayama et al. | |
| 2008/0283231 | A1 * | 11/2008 | Horte | F28D 9/005 165/167 |
| 2009/0194267 | A1 | 8/2009 | Gustafsson | |
| 2009/0229803 | A1 | 9/2009 | Lin | |
| 2011/0024097 | A1 * | 2/2011 | Christensen | F28D 9/005 165/166 |
| 2012/0125578 | A1 | 5/2012 | Persson | |
| 2013/0020062 | A1 | 1/2013 | Blomgren | |
| 2019/0033015 | A1 | 1/2019 | Zhang et al. | |
| 2020/0278158 | A1 | 9/2020 | Nilsson et al. | |

FOREIGN PATENT DOCUMENTS

| | | | |
|---|---|---|---|
| CN | 102016480 | A | 4/2011 |
| CN | 103808189 | A | 5/2014 |
| CN | 204438867 | U | 7/2015 |
| CN | 110073163 | A | 7/2019 |
| DE | 10 2010 036 664 | A1 | 2/2012 |
| DE | 10 2014 005 149 | A1 | 10/2015 |
| EP | 2257759 | B1 | 12/2014 |
| GB | 1346312 | A | 2/1974 |
| JP | H01-503558 | A | 11/1989 |
| JP | H11-311491 | A | 11/1999 |
| JP | 2017-507312 | A | 3/2017 |
| WO | 88/09473 | A1 | 12/1988 |
| WO | 95/00810 | A1 | 1/1995 |
| WO | 2006043864 | A1 | 4/2006 |
| WO | 2015/131834 | A1 | 9/2015 |
| WO | 2018114288 | A1 | 6/2018 |
| WO | 2019029659 | A1 | 2/2019 |
| WO | 2019068426 | A1 | 4/2019 |

OTHER PUBLICATIONS

International Search Report (PCT/ISA/210) and Written Opinion (PCT/ISA/237) mailed on Mar. 23, 2021, by the European Patent Office as the International Searching Authority for International Application No. PCT/EP2021/050785. (4 pages).

First Office Action issued on Jan. 23, 2025, by the China National Intellectual Property Administration in corresponding Chinese Patent Application No. 202180014248.1 and an English translation of the Office Action. (15 pages).

* cited by examiner

HEAT EXCHANGER PLATE, AND A PLATE HEAT EXCHANGER

TECHNICAL FIELD OF THE INVENTION

The present invention refers to a heat exchanger plate to be comprised by a plate heat exchanger configured for heat exchange between a first fluid and a second fluid, according to the preamble of claim 1. The present invention also refers to a plate heat exchanger comprising a plurality of the heat exchanger plates.

BACKGROUND OF THE INVENTION, AND PRIOR ART

In certain plate heat exchanger applications, a high or very high design pressure is required. In other words, the plate heat exchanger must be designed to withstand a high or a very high pressure of one or both of the fluids flowing through the plate interspaces of the plate heat exchanger. It is thus desirable to be able to permit such high pressures in plate heat exchangers of the kind defined above, in particular plate heat exchangers having permanently joined heat exchanger plates, e.g. through brazing. Such high design pressures are difficult to achieve without provision of external strengthening components.

A critical region of the heat exchanger plates is the porthole area around or immediately around a respective one of the portholes. The porthole areas may determine the upper limit for the design pressure.

One example of an application that requires a very high design pressure is plate heat exchangers, for instance evaporators and condensers, in which one or two of the fluids flowing through the plate heat exchanger contains or consists of carbon dioxide, or any other suitable cooling agent requiring a high design pressure. Carbon dioxide is in this context very advantageous from an environmental point of view in comparison with traditional cooling agents containing fluoride, ammonium etc.

EP-2 257 759 B1 discloses a plate heat exchanger comprising a plurality of heat exchanger plates provided beside each other and permanently joined to each other to form a plate package having first plate interspaces and second plate interspaces. Each plate has a heat transfer area and four porthole areas defined by a respective porthole edge. Each of the porthole areas comprises an annular flat area located at one of a primary and secondary level, and a set of inner portions on the annular flat area at the other of the primary and secondary level. Each inner portion has an inner part adjoining the porthole edge and an outer segment adjoining the inner part and having an angular extension of at least 180°. The outer segment has a continuous contour and a radius R.

US 2007/0089872 discloses a heat exchanger comprising a first and second housing. The first housing includes an opening formed therein, and an upper surface having a peripheral swelling extended upwardly therefrom and located around the opening. The peripheral swelling includes a peripheral flange extended into the opening and a groove formed through the peripheral swelling. The second housing includes an opening formed therein, and an upper surface having a peripheral recess formed therein and located around the opening. A peripheral wall extends therefrom and is located between the peripheral recess and the opening. A peripheral flange extends into the opening. The second housing includes a duct extended through the peripheral recess and has a pathway formed therein. The groove of the first housing and the pathway of the second housing form a flowing passage for allowing a heat medium to flow through the peripheral swelling and the peripheral recess when the second housing is disposed on the first housing. The peripheral flanges of the first and said second housings are superposed and contacted with each other when the first housing is disposed on the second housing.

SUMMARY OF THE INVENTION

The object of the present invention is to overcome the problem discussed above. In particular, it is aimed at a heat exchanger plate and a plate heat exchanger, which permit a very high design pressure. In particular, it is aimed at a strengthening of the area around the portholes.

The object is achieved by the heat exchanger plate initially defined, which is characterized in

- that porthole areas comprise two first porthole areas comprising a respective annular base area extending around the porthole and being located at the secondary level,
- that the each of the first porthole areas comprises
  - a first annular ridge provided around the porthole and projecting from the annular base area at the secondary level to the primary level, and
  - a second annular ridge provided around and at a distance from the first annular ridge and projecting from the annular base area at the secondary level to the primary level, and
- that each of the first and second annular ridges is through-broken by a number of depressions.

The first and second annular ridges contribute to strengthen the porthole area. The first porthole area thus permit a plate heat exchanger assembled of such heat exchanger plates to have a high or very high design pressure, for instance up to 140 bars. The plate heat exchanger may thus be suitable for containing or being supplied with for instance carbon dioxide as at least one of the first fluid and the second fluid. Thanks to the annular ridges the resistance against bending of the heat exchanger plate at the porthole areas may be increased or even significantly increased. The first and second annular ridges may be configured to adjoin and be joined to the respective opposite first and second annular ridge of an adjacent heat exchanger plate of the plate heat exchanger, and may thus contribute to a strong first porthole area through the entire plate heat exchanger.

Also the annular base area contributes to strengthen the first porthole area. The annular base area may be configured to adjoin and be joined to the opposite annular base area of an adjacent heat exchanger plate of the plate heat exchanger, and may thus contribute to a strong first porthole area through the entire plate heat exchanger.

According to an embodiment of the invention, the depressions of the first annular ridge and the second annular ridge form a fluid communication path through the first and second annular ridges. The first or second fluid my thus flow from the porthole through the depression or depressions of the first annular ridge into an annular space between the first and second annular ridge, and from said annular space through the depression or depressions of the second annular ridge.

According to an embodiment of the invention, the first and second annular ridges are concentric with the porthole edge.

According to an embodiment of the invention, the porthole edge is circular. Advantageously, also the first and second annular ridges may be circular.

According to an embodiment of the invention, the first annular ridge of each of the first porthole areas is located at a distance from the porthole edge of the respective porthole. An inner annular portion of the annular base area of the heat exchanger plate may thus adjoin and be joined to an inner annular portion of the annular base area of an adjacent heat exchanger plate of the plate heat exchanger, and thus contribute to strengthen the porthole edges throughout the plate heat exchanger.

According to an embodiment of the invention, any one of said number of depressions extending through the first annular ridge is displaced from any radial line of the porthole that extends through the any one of said number of depressions extending through the second annular ridge so that any one of said number of depressions extending through the first annular ridge is located opposite to a portion of the second annular ridge that has no depression. Such a positioning of the depressions contributes to further strengthen the first porthole area of the heat exchanger plate, in particular to increase the bending resistance of the first porthole area.

According to an embodiment of the invention, each of the first porthole areas comprises a third annular ridge provided around and at a distance from the second annular ridge and projecting from annular base area at the secondary level to the primary level. The third annular ridge may contribute to further strengthening the first porthole area.

According to an embodiment of the invention, the third annular ridges is through-broken by a number of depressions.

According to an embodiment of the invention, the depressions of the third annular ridge form a fluid communication path through the third annular ridge.

According to an embodiment of the invention, any radial line of the porthole of the first porthole areas extends through at most two depressions.

According to an embodiment of the invention, the depressions extend to the secondary level.

According to an embodiment of the invention, the number of depressions is at least one and at most ten, at most nine, at most eight, at most seven, at most six, at most five, at most four, at most three or at most two. The number of depressions may be selected for each individual plate heat exchanger and may be determined by the requirements of strength and the need for a large flow area for the first or second fluid. In particular, the first annular ridge may comprise at least one and at most ten, at most nine, at most eight, at most seven, at most six, at most five, at most four, at most three or at most two depressions. Furthermore, the second annular ridge may comprise at least one and at most ten, at most nine, at most eight, at most seven, at most six, at most five, at most four, at most three or at most two depressions. Still further, the third annular ridge may comprise at least one and at most ten, at most nine, at most eight, at most seven, at most six, at most five, at most four, at most three or at most two depressions.

According to an embodiment of the invention, each depression has a width in parallel with a peripheral direction of the porthole edges and a length perpendicular to the width, and wherein the width is in the order of the length. The width of the depressions is thus relatively small. The final width of the depressions may also be determined by the requirements of strength and the need for a large flow area for the first or second fluid.

The object of the invention is also achieved by the plate heat exchanger for evaporation, comprising a plurality of heat exchanger plates as defined above, wherein the heat exchanger plates form first plate interspaces for the first fluid and second plate interspaces for the second fluid. The first and second plate interspaces may be arranged in an alternating order in the plate heat exchanger. The plate heat exchanger may have a high or very high design pressure, for instance up to 140 bars. The plate heat exchanger may thus be suitable for containing or being supplied with carbon dioxide as at least one of the first fluid and the second fluid. Thanks to the annular ridges the strength of the porthole areas may be increased or even significantly increased.

The annular ridges of every second heat exchanger plate may adjoin and be joined to an annular ridge of an adjacent heat exchanger plate to form a strong porthole area. The plate heat exchanger may thus withstand the high or very high design pressures.

According to an embodiment of the invention, the heat exchanger plates are permanently joined to each other through brazing.

According to an embodiment of the invention, at least one of the first and second fluid is carbon dioxide, or any other cooling agent requiring a high design pressure.

According to an embodiment of the invention, every second heat exchanger plate of the plate heat exchanger is arranged so that an upper surface the first annular ridge of one of the heat exchanger plates adjoins an upper surface of the first annular ridge of an adjacent heat exchanger plate. Furthermore, an upper surface the second annular ridge of one of the heat exchanger plates may adjoin an upper surface of the second annular ridge of an adjacent heat exchanger plate. Still further, an upper surface the third annular ridge of one of the heat exchanger plates may adjoin an upper surface of the respective third annular ridge of an adjacent heat exchanger plate.

BRIEF DESCRIPTION OF THE DRAWINGS

The present invention is now to be explained more closely through a description of various embodiments and with reference to the drawings attached hereto.

DETAILED DESCRIPTION OF VARIOUS EMBODIMENTS

Figure 1:
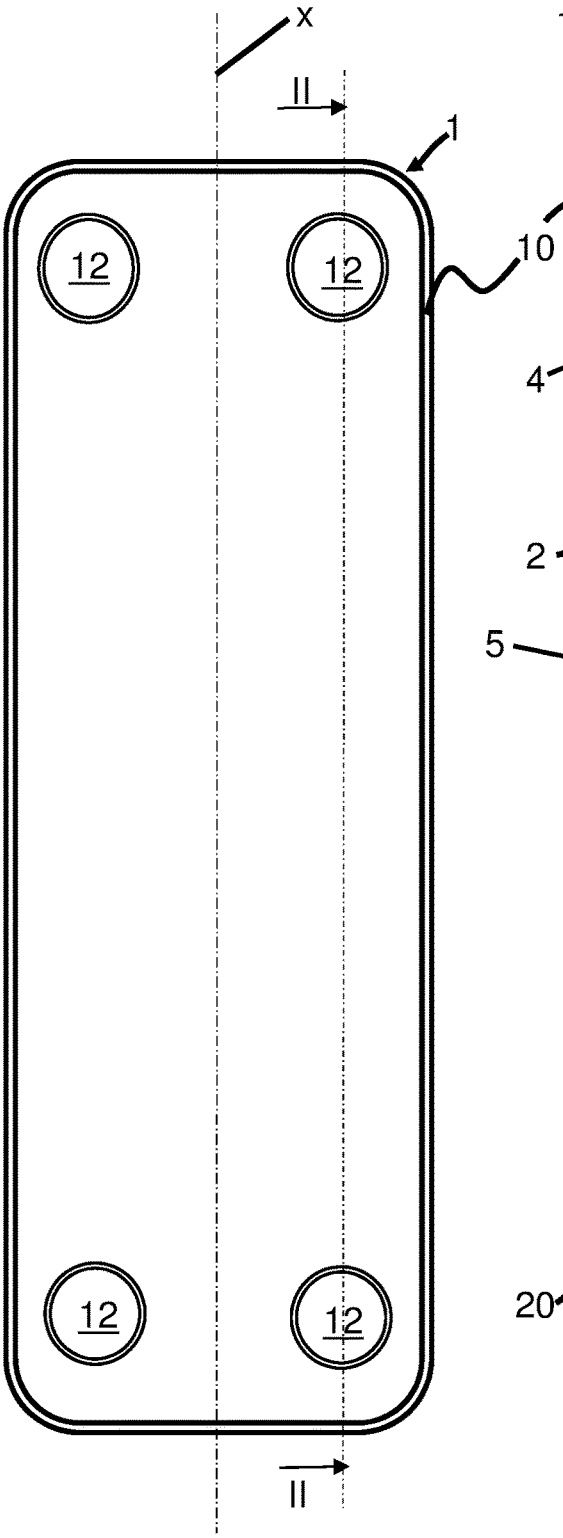
FIG. 1 discloses schematically a plan view of a plate heat exchanger according to a first embodiment of the invention.
Figure 2:
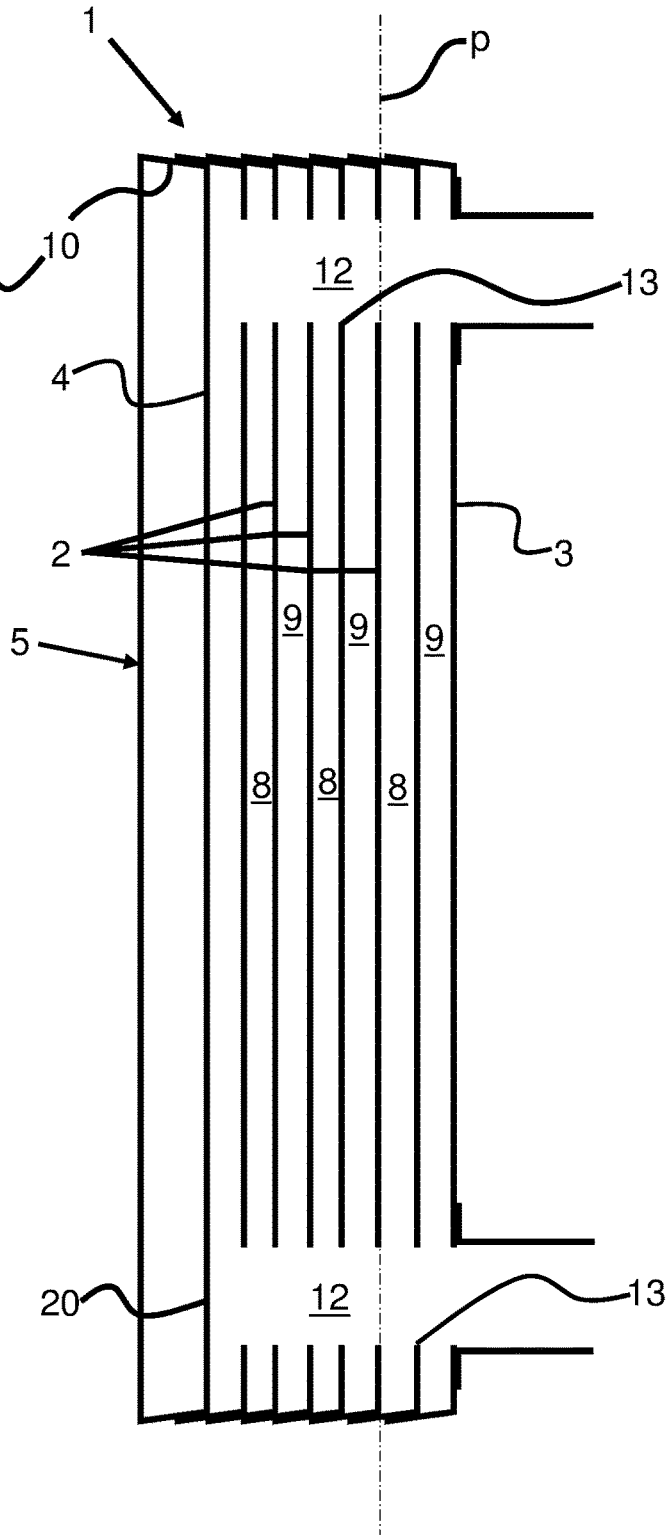
FIG. 2 discloses schematically a longitudinal sectional view along the line II-II in FIG. 1.

FIGS. 1 and 2 disclose a plate heat exchanger 1. The plate heat exchanger 1 comprises a plurality of heat exchanger plates 2 arranged beside each other to be comprised by a plate package 5 of the plate heat exchanger 1. The plate package 5 may also comprise a first end plate 3 and a second end plate 4. The heat exchanger plates 2 are arranged between the first end plate 3 and the second end plate 4, as can be seen in FIG. 2.

Figure 3:
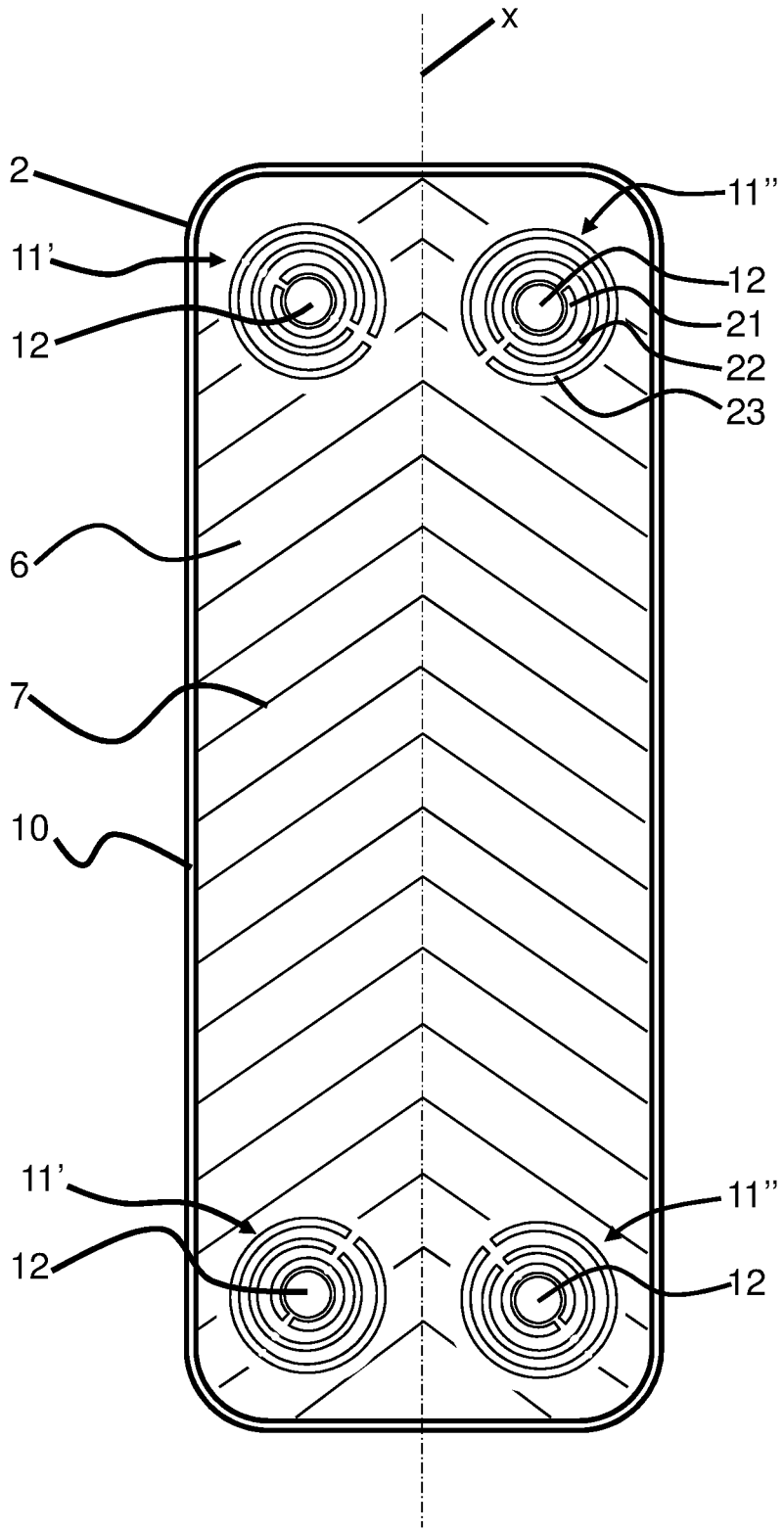
FIG. 3 discloses schematically a plan view of a heat exchanger plate of the plate heat exchanger in FIG. 1.

Each of the heat exchanger plates 2, the first end plate 3 and the second end plate 4 extends along a longitudinal central axis x, indicated in FIGS. 1 and 3.

Each of the heat exchanger plates 2, the first end plate 3, and the second end plate 4 extends in parallel with a respective extension plane p, indicated in FIG. 2.

The heat exchanger plates 2 of the plate package 5 may be permanently joined to each other, and to the first and second end plates 3 and 4, for instance by means of a brazing material and through a brazing process.

Each of the heat exchanger plates 2, see FIG. 3, comprises a heat exchanger area 6 extending in parallel with the extension plane p of the heat exchanger plate 2. The heat exchanger area 6 comprises a corrugation 7 of ridges and valleys. The corrugation 7 extends from a primary level p' on one side of the extension plane p to a secondary level p" on an opposite side of the extension plane p, see FIG. 5. The corrugation 7 is thus oscillating between the primary level p' and the secondary level p". In the plate heat exchanger 1, the valleys of one heat exchanger plate 2 adjoin and are joined to the ridges of an adjacent heat exchanger plate 2. The distance between the primary level p' and the secondary level" is equal to the press depth of the heat exchanger plate 2.

Figure 5:
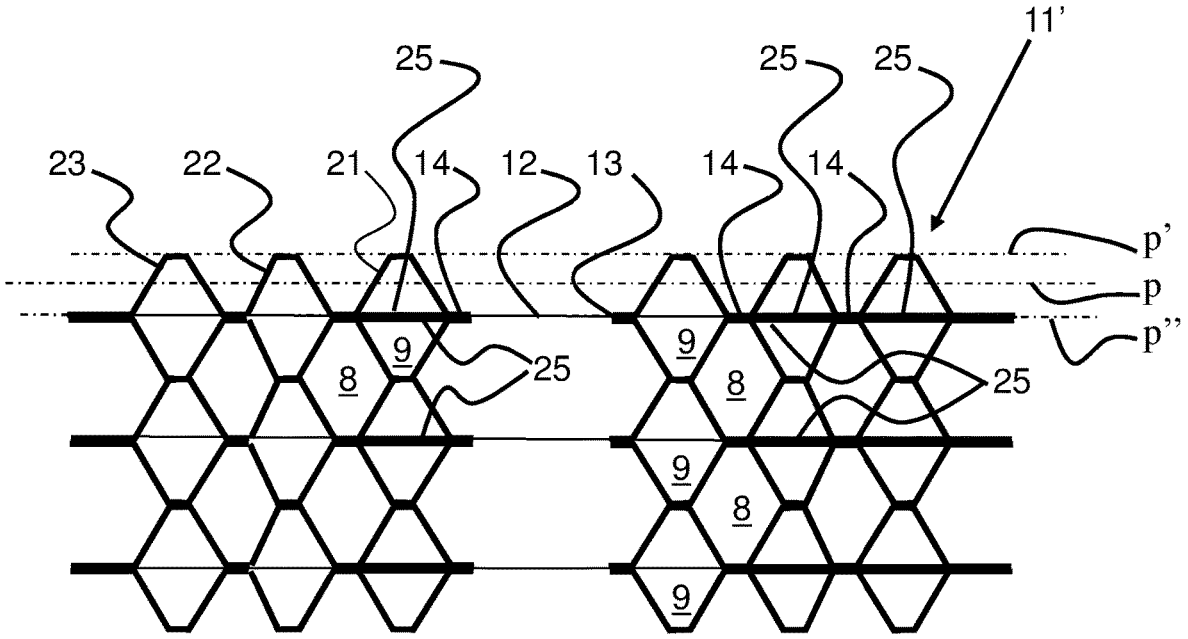
FIG. 5 discloses schematically a sectional view of the first porthole area along the line V-V in FIG. 4.

The heat exchanger plates 2 are stacked onto each other in the plate package 5 to form first plate interspaces 8 for a first fluid and second plate interspaces 9 for a second fluid. The first and second plate interspaces 8 and 9 are arranged in an alternating order in the plate package 5, as illustrated in FIGS. 2 and 5.

Each of the heat exchanger plates 2 also comprises an edge area 10 extending around and enclosing the heat exchanger area 6. The edge area 10 may adjoin the central area 6. The edge area 10 may consist of or may comprise a flange forming an angle of inclination to the extension plane p, see FIG. 2.

In the embodiments disclosed, each of the heat exchanger plates 2 and the first end plate 3, comprises four porthole areas 11', 11" located inside the edge area 10 and each enclosing a respective porthole 12 defined by a porthole edge 13 and extending through the heat exchanger plate 2. The porthole areas 11', 11" comprise two first porthole areas 11' and two second porthole areas 11", see FIG. 3.

In the embodiments disclosed, the portholes 12 of the first porthole areas 11' are comprised by or form an inlet and an outlet, respectively, for the first fluid to and from the first plate interspaces 8. The portholes 12 of the second porthole areas 11" are comprised by or form an inlet and an outlet, respectively, for the second fluid to and from the second plate interspaces 9. As illustrated in FIG. 3, the first porthole areas 11' are located on the same side of the longitudinal central axis x, wherein second porthole areas 11" are located on the other side of the longitudinal central axis x. The porthole areas 11', 11" are thus located to permit so called parallel flow through the plate heat exchanger 1.

Alternatively, the first porthole areas 11' may be located diagonally opposite to each other. It follows that the second porthole areas 11" then will be located diagonally opposite to each other.

In the embodiments disclosed, each of the porthole areas 11', 11" comprises an annular base area 14 extending around the porthole 12 to the porthole edge 13. The annular base area 14 may thus extend from the heat exchanger area 6 and/or the edge area 10 to the porthole edge 13. The annular base area 14 of the first porthole areas 11' is located at or on the secondary level p", see FIG. 5. The annular base area 14 of the second porthole areas 11" is located at or on the primary level p".

Figure 4:
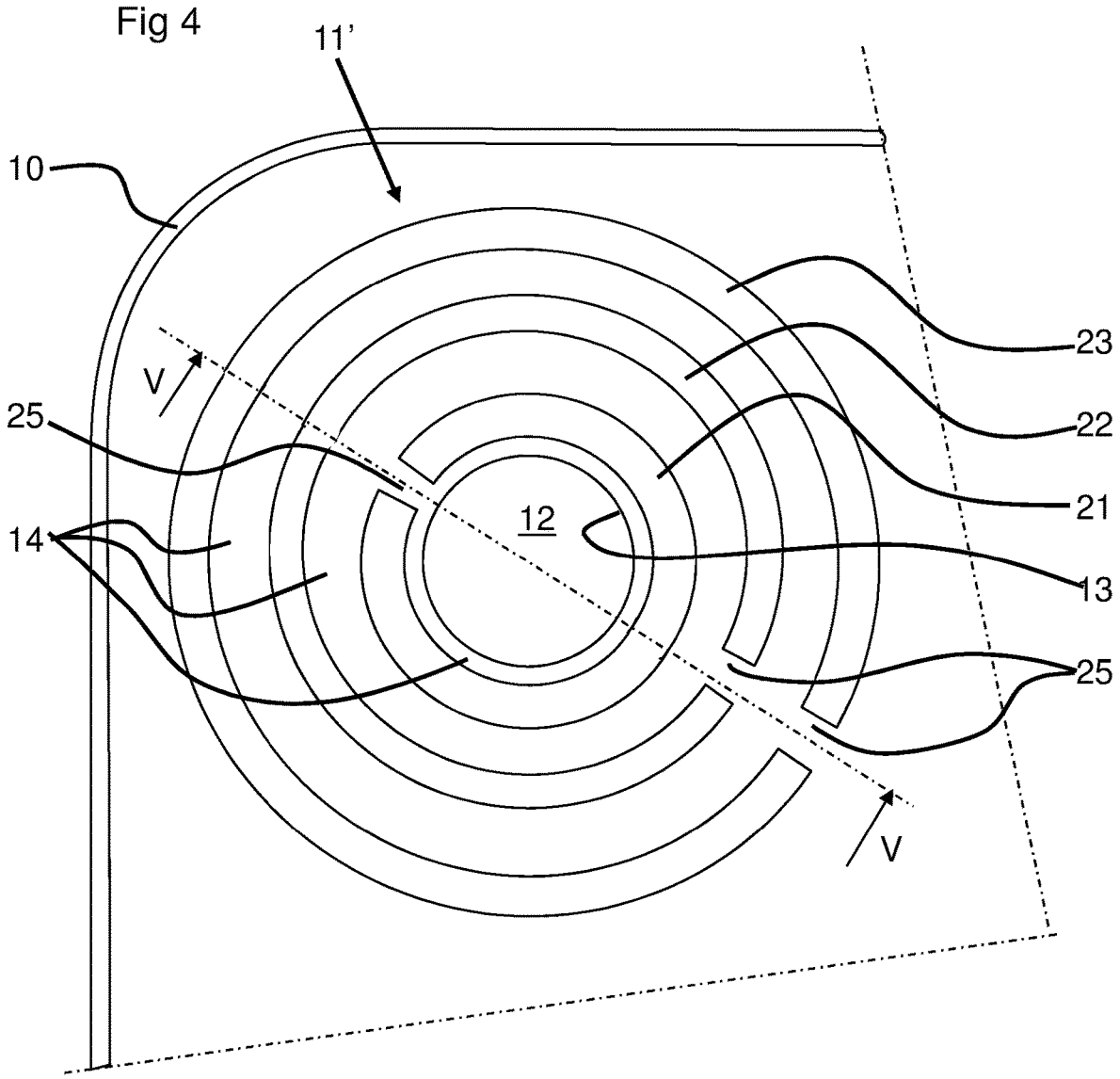
FIG. 4 discloses schematically a plan view of a first porthole area of the heat exchanger plate in FIG. 3.

In the first embodiment, each of the first porthole areas 11' comprises a first annular ridge 21, a second annular ridge 22 and a third annular ridge 23, see FIGS. 4 and 5.

The first annular ridge 21 is provided around the porthole 12 and projects from the annular base area 14 at the secondary level p" to the primary level p'.

The first annular ridge 21 may be located at a distance from the porthole edge 13 of the respective porthole 12. An inner annular portion of the annular base area 14 may thus be provided between the porthole edge 13 and the first annular ridge 21.

The second annular ridge 22 is provided around and at a distance from the first annular ridge 21 and projects from the annular base area 14 at the secondary level p" up to the primary level p'. A first intermediate annular portion of the annular base area 14 may thus be provided between the first annular ridge 21 and the second annular ridge 22.

The third annular ridge 23 provided around and at a distance from the second annular ridge 22 and projects from annular base area 14 at the secondary level p" up to the primary level p'. A second intermediate annular portion of the annular base area 14 may thus be provided between the second annular ridge 22 and the third annular ridge 23.

Each of the first, second and third annular ridges 21, 22, 23 has an upper surface located at the primary level p'. The upper surface may be flat, as schematically illustrated in FIG. 5, or may be curved and thus have a short or line-shaped width.

Each of the first, second and third annular ridges 21, 22, 23 is through-broken by a number of depressions 25, as can be seen in FIGS. 4 and 5. The depressions 25 of the first annular ridge 21, the second annular ridge 22 and the third annular ridge 23 form a fluid communication path through the respective first, second and third annular ridges 21, 22, 23.

The depressions 25 of the first, second and third annular ridges 21, 22, 23 extend from the upper surface at the primary level p' to the secondary level p", i.e. to the same level as the annular base area 14.

It should be noted that all or some of the depressions 25 of some or all of the first, second and third annular ridges 21, 22, 23 may extend from the upper surface at the primary level p' to an intermediate level above, or at a distance from, the secondary level p".

Each of the depressions 25 of the first, second and third annular ridges 21, 22, 23 has a width in parallel with a peripheral direction of the porthole edges 13 and a length in a radial direction perpendicular to the width. The width of the depressions 25 may be equal to, or in the order of, the length of the depressions 25.

Each of the first, second and third annular ridges 21, 22, 23 comprises at least one depression 25 in order to permit fluid flow from the porthole 12 to the plate interspace 8, 9 adjacent to the heat exchanger area 6. In the first embodiment, each of the first, second and third annular ridges 21, 22, 23 comprises only one depression 25.

Each of the first, second and third annular ridges 21, 22, 23 may comprise at most ten, at most nine, at most eight, at most seven, at most six, at most five, at most four, at most three or at most two depressions 25. The number of depressions 25 may be equal for each of the first, second or third annular ridge 21, 22, 23. Alternatively, the first, second and third annular ridges 21, 22, 23 may have different numbers of depressions 25. The number of depressions 25 may be selected for each individual heat exchanger plate 2 or plate heat exchanger 1, and may be determined by the requirements of strength and the need for a large flow area for the first or second fluid.

In the first embodiment, any radial line of the porthole 12 of the first porthole areas 11' extends through at most two depressions 25 from the center of the porthole 12. In particular, there is a radial line extending from the center of the porthole 12 through the depressions 25 of the second and third annular ridges 22, 23, and through a portion of the first annular ridge 21 that has no depression 25, as can be seen in FIG. 4. Furthermore, there is a radial line extending from the center of the porthole 12 through the depression 25 of the first annular ridge 21, and through a portion of the second and third annular ridges 22 that has no depression 25, as can also be seen in FIG. 4.

The two second portholes areas 11" may have the same configuration as the two first porthole areas 11', but the first, second and third annular ridges 21, 22, 23 may instead extend from annular base area 14 at or on the primary level p' to the secondary level p". The depressions 25 of the first, second and third ridges 21, 22, 33 may thus extend form the secondary level p", and all the way to the primary level p', or to an intermediate level.

In the plate heat exchanger 1, every second heat exchanger plate 2 may be arranged so that an upper surface the first, second and third annular ridges 21, 22, 23 of one heat exchanger plate 1 adjoins, and may be joined to, an upper surface of the respective on of the first, second and third annular ridges 21, 22, 23 of an adjacent heat exchanger plate 1. Furthermore, the annular base area 14 of the porthole areas 11', 11" of one heat exchanger plate 2 may adjoin and be joined to an opposite annular base area 14 of an adjacent heat exchanger plate 2. This arrangement of the heat exchanger plats may be achieved by pressing two different kinds of heat exchanger plates, by rotating every second heat exchanger plate 180 degrees in the extension plane p. In the latter case, all of the porthole areas 11', 11" need to have the same configuration, or diagonally positioned porthole areas 11', 11" need to have the same configuration.

As illustrated in FIG. 5, the depression 25 of the first annular ridge 21 of one heat exchanger plate 2 is located opposite to the depression 25 of the first annular ridge 25 of the adjacent heat exchanger plate 2 and of the remaining heat exchanger plates 2 of the plate heat exchanger 1. Also the depressions 25 of the second and third annular ridges 22, 23 of one heat exchanger plate 2 are located opposite to the depressions 25 of the respective second and third annular ridges 25 of the adjacent heat exchanger plate 2 and of the remaining heat exchanger plates 2 of the plate heat exchanger 1. This configuration means that the depressions 25 may create a fluid communication path having a height corresponding to the distance between adjacent heat exchanger plates 2, or in other words two times the press depth.

Alternatively, the depressions 25 of one or more of the first, second and third annular ridges 21-23 may be displaced in a peripheral direction from the depression of the respective annular ridge 21-23 of the adjacent heat exchanger plates 2. This configuration means that the depressions 25 may create a fluid communication path having a height corresponding to half the distance between adjacent heat exchanger plates 2, or in other words half the press depth.

Figure 6:
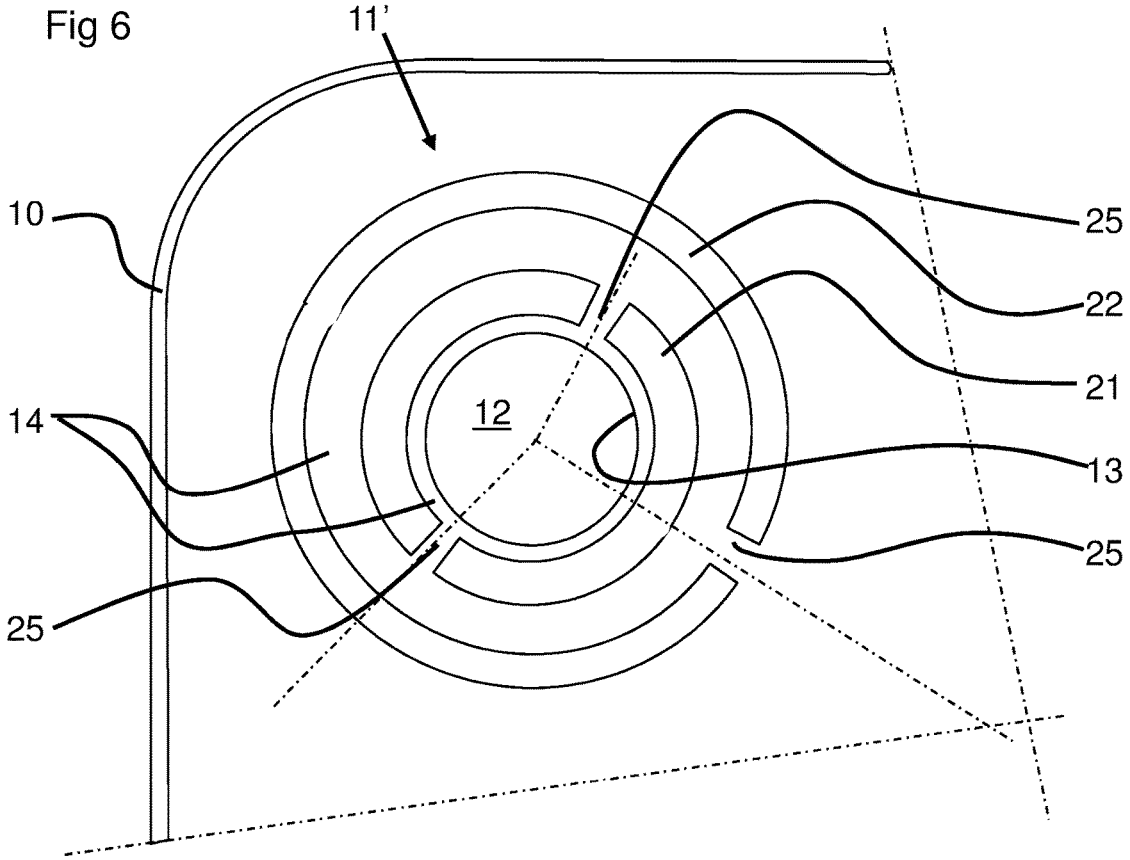
FIG. 6 discloses schematically a plan view of a first porthole area of a heat exchanger plate according to a second embodiment of the invention.

FIG. 6 illustrates a second embodiment, which differs from the first embodiment in that each of the first porthole areas 11' and the second porthole areas 11" comprises only a first annular ridge 21 and a second annular ridge 22. In the second embodiment, the first annular ridge 21 comprises two depressions 25 and the second annular ridge 22 comprises one depression 25. Furthermore, the depressions 25 extending through the first annular ridge 21 are displaced from any radial line of the porthole 12 that extends through the depression 25 extending through the second annular ridge 22 so that the depressions 25 extending through the first annular ridge 21 are located opposite to a portion of the second annular ridge 22 that has no depression 25.

Figure 7:
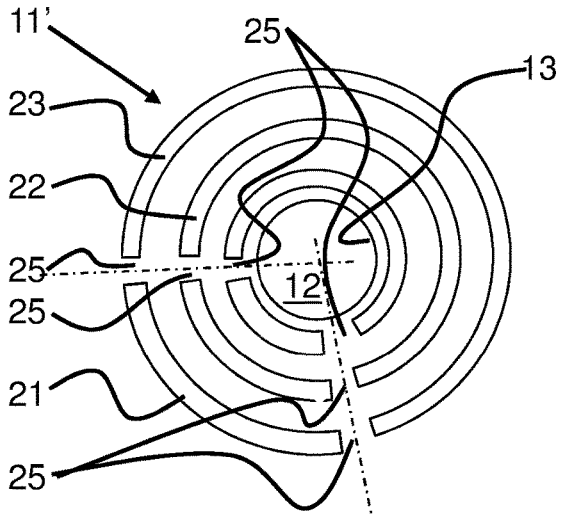
FIG. 7 discloses schematically a plan view of a first porthole area of a heat exchanger plate according to a third embodiment of the invention.

FIG. 7 illustrates a third embodiment, which differs from the first embodiment in that each of the first, second and third annular ridges 21, 22, 23 comprises two depressions 25, i.e. a first and a second depression 25. A radial line extends from the center of the porthole 12 through the first depression 25 of each of the first, second and third annular ridges 21, 22, 23, and another radial line extends from the center of the porthole 12 through the second depression 25 of each of the first, second and third annular ridges 21, 22, 23.

Figure 8:
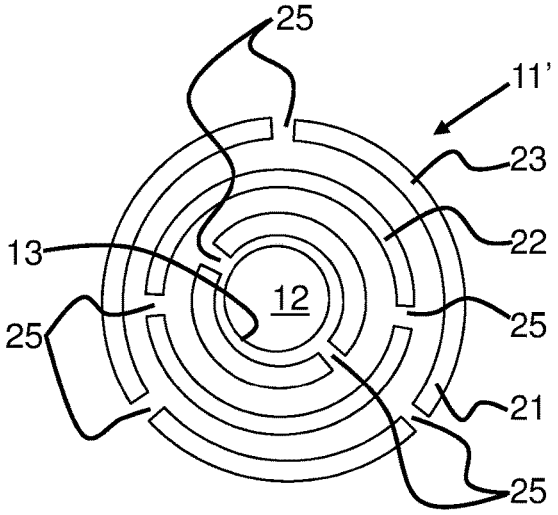
FIG. 8 discloses schematically a plan view of a first porthole area of a heat exchanger plate according to a fourth embodiment of the invention.

FIG. 8 illustrates a third embodiment, which differs from the first embodiment in that each of the first and second annular ridges 21, 22 comprises two depressions 25, i.e. a first and a second depression 25. The third annular ridge 23 comprises three depressions 25. The depressions 25 are located so that any radial line, that extends from the center of the porthole 12, mat extend through only one of the first depressions 25.

It should be noted that there are many various possibilities to arrange the depressions 25 through the different annular ridges 21, 22, 23, both with regard the number of depressions 25 and the positions of the different depressions 25.

The invention is not limited to the embodiments disclosed, but may be varied and modified within the scope of the following claims.

The invention claimed is:

1. A heat exchanger plate to be comprised by a plate heat exchanger configured for heat exchange between a first fluid and a second fluid, the heat exchanger plate comprising a heat exchanger area extending in parallel with an extension plane of the heat exchanger plate and comprising a corrugation of ridges and valleys, wherein the corrugation extends from a primary level on one side of the extension plane to a secondary level on an opposite side of the extension plane, an edge area extending around the heat exchanger area, and a number of porthole areas located inside the edge area and each enclosing a respective porthole defined by a porthole edge and extending through the heat exchanger plate, that porthole areas comprise two first porthole areas comprising a respective annular base area extending around the porthole and being located at the secondary level, that each of the first porthole areas comprises a first annular ridge provided around the porthole and projecting from the annular base area at the secondary level to the primary level, the first annular ridge having an inner periphery facing towards and spaced from the porthole edge, a second annular ridge provided around and at a distance from the first annular ridge and projecting from the annular base area at the secondary level to the primary level, the second annular ridge having an outer periphery facing away from the first annular ridge, a portion of the outer periphery of the second annular ridge facing towards and being spaced from the heat exchanger area comprised of the corrugation of ridges and valleys, and that each of the first and second annular ridges is through-broken by a number of depressions.

2. A heat exchanger plate according to claim 1, wherein the depressions of the first annular ridge and the second annular ridge form a fluid communication path through the first and second annular ridges.

3. A heat exchanger plate according to claim 1, wherein the first annular ridge of each of the first porthole areas is located at a distance from the porthole edge of the respective porthole.

4. A heat exchanger plate according to claim 1, wherein any one of said number of depressions extending through the first annular ridge is displaced from any radial line of the porthole that extends through the any one of said number of depressions extending through the second annular ridge so that any one of said number of depressions extending through the first annular ridge is located opposite to a portion of the second annular ridge that has no depression.

5. A heat exchanger plate according to claim 1, wherein each of the first porthole areas comprises a third annular ridge provided around and at a distance from the second annular ridge and projecting from annular base area at the secondary level to the primary level.

6. A heat exchanger plate according to claim 5, wherein the third annular ridges is through-broken by a number of depressions.

7. A heat exchanger plate according to claim 6, wherein the depressions of the third annular ridge form a fluid communication path through the third annular ridge.

8. A heat exchanger plate according to claim 6, wherein any radial line of the porthole of the first porthole areas extends through at most two depressions.

9. A heat exchanger plate according to claim 1, wherein the depressions extend to the secondary level.

10. A heat exchanger plate according to claim 1, wherein the number of depressions is at least one and at most ten.

11. A heat exchanger plate according to claim 1, wherein each depression has a width in parallel with a peripheral direction of the porthole edges and a length perpendicular to the width, and wherein the width is in the order of the length.

12. A plate heat exchanger for evaporation, comprising a plurality of heat exchanger plates according to claim 1, wherein the heat exchanger plates form first plate interspaces for the first fluid and second plate interspaces for the second fluid.

13. A plate heat exchanger according to claim 12, wherein the heat exchanger plates are permanently joined to each other through brazing.

14. A plate heat exchanger according to claim 12, wherein at least one of the first and second fluid is carbon dioxide.

15. A plate heat exchanger according to claim 12, wherein the plurality of heat exchanger plates of the plate heat exchanger are arranged so that an upper surface of the first annular ridge of one heat exchanger plate adjoins an upper surface of the first annular ridge of an adjacent heat exchanger plate.

16. A heat exchanger plate according to claim 1, wherein the number of depressions is at least one and at most six.

17. A heat exchanger plate according to claim 1, wherein the number of depressions is at least one and at most seven.

18. A heat exchanger plate according to claim 1, wherein the number of depressions is at least one and at most eight.

19. A heat exchanger plate according to claim 1, wherein the number of depressions is at least one and at most nine.

20. A heat exchanger plate to be comprised by a plate heat exchanger configured for heat exchange between a first fluid and a second fluid, the heat exchanger plate comprising a heat exchanger area extending in parallel with an extension plane of the heat exchanger plate and comprising a corrugation of ridges and valleys, wherein the corrugation extends from a primary level on one side of the extension plane to a secondary level on an opposite side of the extension plane, an edge area extending around the heat exchanger area, and a number of porthole areas located inside the edge area and each enclosing a respective porthole defined by a porthole edge and extending through the heat exchanger plate, that porthole areas comprise two first porthole areas comprising a respective annular base area extending around the porthole and being located at the secondary level, that each of the first porthole areas comprises a first annular ridge provided around the porthole and projecting from the annular base area at the secondary level to the primary level, a second annular ridge provided around and at a distance from the first annular ridge and projecting from the annular base area at the secondary level to the primary level, and a third annular ridge provided around and at a distance from the second annular ridge and projecting from the annular base area at the secondary level to the primary level, and each of the first and second annular ridges being through-broken by a number of depressions.

21. A heat exchanger plate to be comprised by a plate heat exchanger configured for heat exchange between a first fluid and a second fluid, the heat exchanger plate comprising a heat exchanger area extending in parallel with an extension plane of the heat exchanger plate and comprising a corrugation of ridges and valleys, wherein the corrugation extends from a primary level on one side of the extension plane to a secondary level on an opposite side of the extension plane, an edge area extending around the heat exchanger area, and a number of porthole areas located inside the edge area and each enclosing a respective porthole defined by a porthole edge and extending through the heat exchanger plate, that porthole areas comprise two first porthole areas comprising a respective annular base area extending around the porthole and being located at the secondary level, that each of the first porthole areas comprises a first annular ridge provided around the porthole and projecting from the annular base area at the secondary level to the primary level, the annular base area including an inner annular portion that is located at the secondary level and that is between the porthole edge and the first annular ridge, anda second annular ridge provided around and at a distance from the first annular ridge and projecting from the annular base area at the secondary level to the primary level, the second annular ridge having an inner periphery facing towards the first annular ridge and an outer periphery facing away from the first annular ridge, a portion of the outer periphery of the second annular ridge: i) facing towards the heat exchanger area comprised of the corrugation of ridges and valleys; and ii) being concentric with the porthole edge, and that each of the first and second annular ridges is through-broken by a number of depressions.

22. A heat exchanger plate to be comprised by a plate heat exchanger configured for heat exchange between a first fluid and a second fluid, the heat exchanger plate comprising a heat exchanger area extending in parallel with an extension plane of the heat exchanger plate and comprising a corrugation of ridges and valleys, wherein the corrugation extends from a primary level on one side of the extension plane to a secondary level on an opposite side of the extension plane, an edge area extending around the heat exchanger area, and a number of porthole areas located inside the edge area and each enclosing a respective porthole defined by a porthole edge and extending through the heat exchanger plate, that porthole areas comprise two first porthole areas comprising a respective annular base area extending around the porthole and being located at the secondary level, that each of the first porthole areas comprises a first annular ridge provided around the porthole and projecting from the annular base area at the secondary level to the primary level, and a second annular ridge provided around and at a distance from the first annular ridge and projecting from the annular base area at the secondary level to the primary level, the second annular ridge having an outer periphery facing away from the first annular ridge, an entirety of the outer periphery of the second annular ridge being spaced from the edge area, and that each of the first and second annular ridges is through-broken by a number of depressions.

23. A heat exchanger plate to be comprised by a plate heat exchanger configured for heat exchange between a first fluid and a second fluid, the heat exchanger plate comprising a heat exchanger area extending in parallel with an extension plane of the heat exchanger plate and comprising a corrugation of ridges and valleys, wherein the corrugation extends from a primary level on one side of the extension plane to a secondary level on an opposite side of the extension plane, an edge area extending around the heat exchanger area, and a number of porthole areas located inside the edge area and each enclosing a respective porthole defined by a porthole edge and extending through the heat exchanger plate, that porthole areas comprise two first porthole areas comprising a respective annular base area extending around the porthole and being located at the secondary level, that each of the first porthole areas comprises a first annular ridge provided around the porthole and projecting from the annular base area at the secondary level to the primary level, and a second annular ridge provided around and at a distance from the first annular ridge and projecting from the annular base area at the secondary level to the primary level, the second annular ridge having an outer periphery facing away from the first annular ridge, the annular base area including an intermediate annular portion located at the secondary level, the intermediate annular portion of the annular base area surrounding an entirety of the outer periphery of the second annular ridge, and that each of the first and second annular ridges is through-broken by a number of depressions.

24. A heat exchanger plate to be comprised by a plate heat exchanger configured for heat exchange between a first fluid and a second fluid, the heat exchanger plate comprising a heat exchanger area extending in parallel with an extension plane of the heat exchanger plate and comprising a corrugation of ridges and valleys, wherein the corrugation extends from a primary level on one side of the extension plane to a secondary level on an opposite side of the extension plane, an edge area extending around the heat exchanger area, and a number of porthole areas located inside the edge area and each enclosing a respective porthole defined by a porthole edge and extending through the heat exchanger plate, that porthole areas comprise two first porthole areas comprising a respective annular base area extending around the porthole and being located at the secondary level, that each of the first porthole areas comprises a first annular ridge provided around the porthole and projecting from the annular base area at the secondary level to the primary level, and a second annular ridge provided around and at a distance from the first annular ridge and projecting from the annular base area at the secondary level to the primary level, the annular base area including an intermediate annular portion that: i) is located at the secondary level; ii) is continuous; iii) and surrounds the second annular ridge, and that each of the first and second annular ridges is through-broken by a number of depressions.

* * * * *